United States Patent [19]

Gregoire

[11] 4,345,906

[45] Aug. 24, 1982

[54] CAM OPERATED GRIPPERS FOR PRINTED WEBS

[75] Inventor: Clyde G. Gregoire, Bensenville, Ill.

[73] Assignee: Baldwin-Gregg, Inc., Lyons, Ill.

[21] Appl. No.: 202,599

[22] Filed: Oct. 31, 1980

[51] Int. Cl.[3] ..... B65H 45/16

[52] U.S. Cl. ..... 493/432

[58] Field of Search ..... 271/277; 101/409–410; 493/424–433; 270/4–9

[56] References Cited

U.S. PATENT DOCUMENTS

| | | | |
|---|---|---|---|
| 674,356 | 5/1901 | Feister | 493/429 |
| 1,406,978 | 2/1922 | Cottrell | 271/277 X |
| 3,985,074 | 10/1976 | Bonsch | 271/277 X |
| 4,024,814 | 5/1977 | Becker | 271/277 X |

*Primary Examiner*—William Pieprz
*Assistant Examiner*—A. Heinz
*Attorney, Agent, or Firm*—Kenneth T. Snow

[57] ABSTRACT

An apparatus for the printing industry relating to the folding of printed webs. More particularly the invention concerns the means for uniformly gripping the full width of a wide printed web at intermittent periods to obtain accurate folding. The gripping apparatus is opened and closed by an endwise shifting of an actuator. A cam at one end causes the actuating member to shift one way and then a cam at the other end shifts the actuating member in the other direction. The actuator member is itself cammed to move fore and aft as it moves endwise and imparts only its fore and aft movement to a movable gripper jaw. There is no arcuate swinging of a rod such as in previous devices and hence there are no adverse effects of torque or twisting occuring during the gripping operation. The present construction permits uniform gripping of the full width of the printed web without any tendency of the operator member to twist and irregularly grip the web.

4 Claims, 5 Drawing Figures in the spaced end or side walls 11 and 12. A spaced apart second operational roller 16 is carried on a shaft 17 similarly journally supported in the spaced end walls 11 and 12. As the printed web 13 passes between these cooperative operational rollers 14 and 16 it is acted upon by the elements in the working boxes mounted on these operational rollers. The plural working boxes as shown in greater detail in my earlier U.S. Pat. Nos. 4,073,485 and 4,113,243 effect a folding of the printed web.

A working box 18 is mounted on the roller 14 and is similar to the working box 26 of my earlier U.S. Pat. No. 4,073,485. This working box 18 carries a radially disposed tucking blade 19 which is utilized to effect a tucking of the printed web into a gripping device on the cooperative operational roller 16. The operational roller 16 carries a working box 20 directly opposite the working box 18 of the roller 14. The present invention is concerned principally with the gripping elements employed in this working box 20 and particularly the operation of opening and closing the gripping jaws thereof. The box 20 is constructed of a generally steel block 21 having a concavely curved underside 22 which is adapted to snuggly engage the outer cylindrical surface of the operational roller 16. The box further includes a generally radially cut passageway 23 to receive a bolt 24 to fasten the box 20 to the roller 16 in any desired arcuate position. In the present instance only one such bolt 24 has been illustrated but depending upon the transverse extent of the rollers used it is understood that any number of such bolts may be used at spaced apart positions to effect a secure fastening of the box to the roller. The working box 20 further includes a convexly shaped outer or top surface 25 which is generally concentric with the cylindrical surface of the operational roller 16. A stationary jaw 26 is inset in the block 21 along the top surface and adjacent the front side of the box which is defineld as that side carrying a movable jaw 27. The movable jaw 27 cooperates with the stationary jaw 26 to grip a bight 28 of the printed web 13. The movable jaw 27 comprises a rectangularly shaped vertically disposed plate. It is the upper edge of the longer top side of the plate that is utilized as the gripper jaw and cooperates with the fixed stationary jaw 26 located in the top of the working box 20. The bight 28 is formed by the tucking blade member 19 pressing against the printed web and pushing the formed bight into the open jaws of the gripper member as the operational rollers 14 and 16 rotate in the direction of the arrows 51 and 52.

The working box 20 is provided with a horizontally disposed elongated groove 29 in the block portion 21. The groove 29 is open at the front edge of the block. An elongated actuating member 30 is slidable endwise in the groove 29. Inclined cam slots 31 are provided at intervals in the actuator member 30 as best shown in FIG. 5. Screws 32 are disposed vertically in the block 21 and threadedly engage the block as shown in FIGS. 2, 3 and 4. The screws 32 are provided with enlarged heads 33 which are disposed beneath the stationary jaw 26. The screws further include shanks 34 which act as bushings for the receipt of rollers 35 thereover. The rollers 35 are journally carried on the bushing shanks 34 and there is one such roller disposed within each of the inclined cam slots 31. The rollers are thus in a fixed position in the block 21 and merely rotate on their fixed axes. As the elongated actuator member 30 moves endwise in the groove 29 the included inclined cam slots 31 cause the rollers 35 to ride upwardly and/or downwardly to in turn cause the movable jaw 27 to be either opened or closed relative to the stationary jaw 26.

The working box 20 further includes an elongated bridge member 36 lying parallel with the actuator member 30 and the movable jaw 27. A spacer 37 just slightly greater in thickness than the thickness of the movable jaw 27 is located at one end of the bridge 36. The spacer 37 has its other side abutting the elongated actuator member 30. Similarly a spacer 38 of the same thickness as the spacer 37 is provided at the other end of the bridge 36 to thus provide a space between the actuator member 30 and the bridge 36.

A bolt 39 at one end of the bridge 36 passes through the bridge, through the spacer, and is threaded into the actuator member 30. Similarly a bolt 40 located at the other end of the bridge 36 passes through the bridge 36, through the spacer 38, and thence is threaded into the actuator member 30. With this construction the bridge, the spacers and the actuator member move as a unit when the actuator member is slid endwise in the groove 29 in the working box block 21. The rectangularly shaped movable jaw 27 thus has limited sliding freedom within the space defined between the actuator member 30 and the bridge 36 and between the end spacers 37 and 38.

As best shown in FIG. 2 a hole 41 is provided through the end of the actuator member 30 and receives a bolt 42 having a head 43 and a shank 44. Cam rollers 45 are journally carried on the shank 44 of the bolt 42. A nut 46 is threadedly engaged with the lower end of the bolt shank to thereby confine the cam rollers in a position adjacent the end of the actuator member 30. As shown in FIGS. 2 and 5 the rollers 45 are adapted to abut the end wall 11 of the folding machine of this invention. A hole 47, comparable to the hole 41, is provided in or adjacent the other end of the actuator member 30 and is the means for supporting cam rollers 48 on that other end of the actuator member. The mounting of the cam rollers 48 is the same as that shown for the rollers 45. An inclined cam 49 is provided on the inner surface of the end wall 11 and a comparable but arcuately offset inclined cam 50 is provided on the inner surface of the end wall 12. The particular positions of the cams 49 and 50 are determined by the desired timing of the opening and the closing of the gripper jaws. The operational roller 16 rotates within and between the walls 11 and 12. In the arcuate position of the roller 16 as shown in FIG. 5 the cam rollers 48 have ridden up on the inclined cam 50 causing the actuator member to be moved as far to the left as possible. It is in this position of the actuator member that the jaws of the gripper are closed. Continued rotation of the operational roller 16 permits the cam rollers 48 to ride off the cam 50 and at the proper time the cam rollers 45 ride up the inclined cam 49 on the end wall 11 thus causing the actuator member 30 to shift in a rightward direction to the dashed-line position of the actuator member 30 of FIG. 5. The dashed-line position of the actuator member indicates the open position of the jaws of the gripper.

The rectangular plate movable gripper jaw 27 is supported between the actuator member 30 and its spaced apart bridge 36 and thus moves in and out with respect to the stationary gripper jaw 26 when the actuator member moves endwise. However, as the jaw plate 27 has slidable movement capabilities between the actuator member 30 and its bridge 36 it is necessary to employ means to confine it in this environment. Confining bolts

CAM OPERATED GRIPPERS FOR PRINTED WEBS

BACKGROUND OF THE INVENTION

1. Field of the Invention

The present invention concerns the printing industry and more particularly web folding machines. One of the steps of folding a printed web is to temporarily grip the web and then release that gripping. In order to make accurate folds it is necessary to uniformly grip a printed web over its full width. The instant invention employs a gripper with a fixed or stationary jaw and a movable jaw. The invention directly relates to the accurate movement of the movable jaw toward and away from the fixed jaw to uniformly grip a bight of a printed web.

2. Description of the Prior Art

In our two earlier U.S. patents we employed grippers for engaging a printed web in its folding. In both of these prior patents, a rod, identified by the numeral 40 in U.S. Pat. No. 4,073,485 and by the numeral 45 in U.S. Pat. No. 4,113,243, was used to effect an opening and a closing of the movable jaw of the gripper. The rods 40 and 45 were mounted in such a manner as to permit rocking. The movable jaw was joined with one side of the rod and a depending arm from the other substantially diametrically opposite side of the rod was provided with actuating arms at each end. These actuating arms were caused to be arcuately swung by cams in the end of the web folding machine. Thus, as the cams engaged the actuating arms the rod was rotated a sufficient degree to either close or open the gripper means.

The folding machines are used to effect a folding of a wide printed web and it is essential that the gripper means used in the folding machine uniformly grip the web over its full width so that accurate folding may be obtained. Both rods 40 and 45 of these previous devices were subject to torque and twisting which adversely affected the uniformity of the gripping of the web and thus it was essential that the diameter of that gripper actuating rod be increased substantially to hold the desired uniformity of gripping. Now with the advent of even greater widths of printed webs being folded the required diameter of the actuating rod in our previous devices becomes prohibitive because of weight and size.

The present invention concerns the uniform gripping of a wide printed web over its full width without the employment of a rod which is subject to torque and twisting.

SUMMARY OF THE INVENTION

A principal object of the present invention is to provide a novel cam operated gripper for printed webs.

An important object of this invention is to provide a novel means for effecting movement of a jaw by endwise operating cams.

Another important object of this invention is to provide in a folding apparatus for printed webs a novel gripper for uniformly engaging a bight of the printed web across its full width.

A further important object of this invention is to provide in the gripper defined in the preceding object, a stationary jaw and a jaw movable toward and away from the stationary jaw to permit the insertion of the web bight when the movable jaw is spaced from the stationary jaw and to grip the web bight when the movable jaw is engaging the stationary jaw.

Another and further important object of this invention is to provide in the gripper defined in the two preceding objects an elongated cam actuated member associated with the movable jaw and having a plurality of spaced apart generally parallel inclined slots, and fixed position cam rollers associated therewith and disposed one in each of the inclined slots whereby endwise movement of the elongated member causes the inclined slots to move up or down on the fixed cam rollers to in turn cause the movable jaw to move toward or away from the stationary jaw.

Another and still further important object of this invention is to provide in the gripper defined in the preceding three objects, a cam at one end of the device to effect shifting of the elongated member in one direction, and a cam at the other end of the device to effect shifting of the elongated member in the other direction, and said endwise shifting cams timed with each other to effect a jaw opening at the time of the web bight insertion and effect a jaw closing when it is desired to grip the web bight.

Still another important object of this invention is to provide in the gripper defined in the preceding four objects, novel means for carrying the movable jaw with the elongated member and confining the movable jaw to a fixed portion of the gripper and limiting the movement of the movable jaw to a translational movement.

Other and further important objects and advantages will become apparent from the following description and accompanying drawings.

IN THE DRAWINGS

AS SHOWN IN THE DRAWINGS

Figure 1:
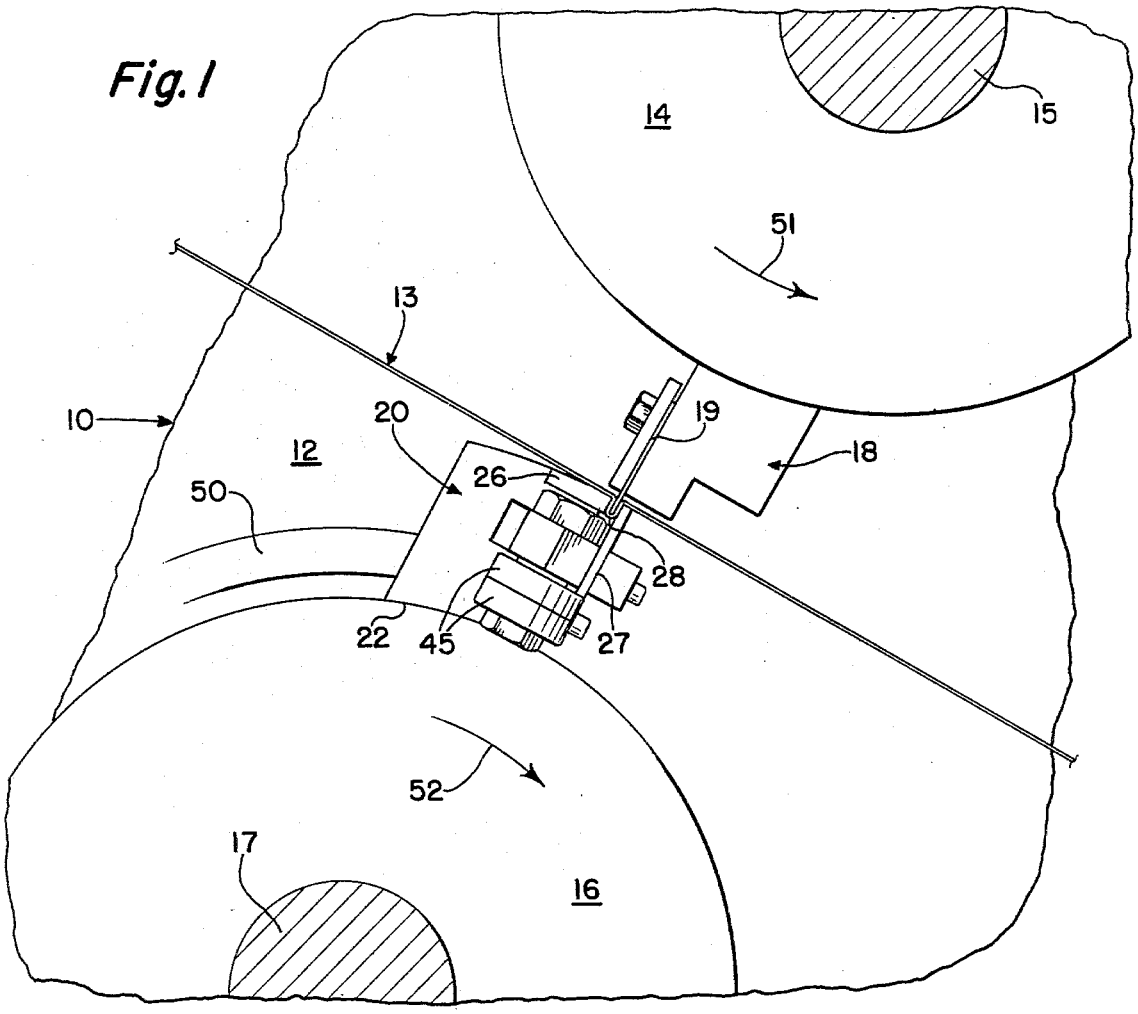
FIG. 1 is a vertical sectional view taken through a pair of cooperative operational rollers in a printed web folding machine.

The reference numeral 10 indicates generally a frame for a folding machine used in the printing industry. The present device is concerned with a folding machine used in conjunction with a printing press and wherein a printed web from the printing press is delivered directly into a folding machine. This is similar to our previous U.S. Pat. No. 4,073,485. As in the earlier device the frame 10 includes generally parallel spaced apart walls 11 and 12. These walls provide the journal supports for a plurality of rollers or cylinders used in the folding of the printed web.

Figure 3:
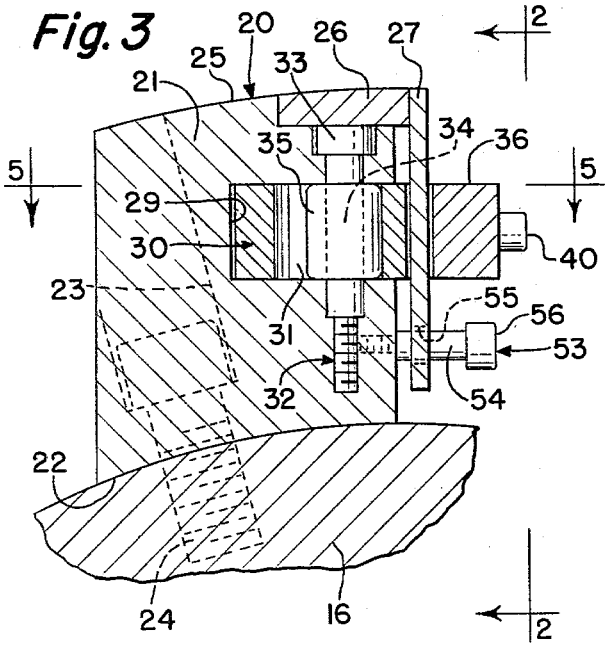
FIG. 3 is a sectional view through the working box taken on the line 3—3 of FIG. 2 and showing the gripping jaws of that working box closed.
Figure 4:
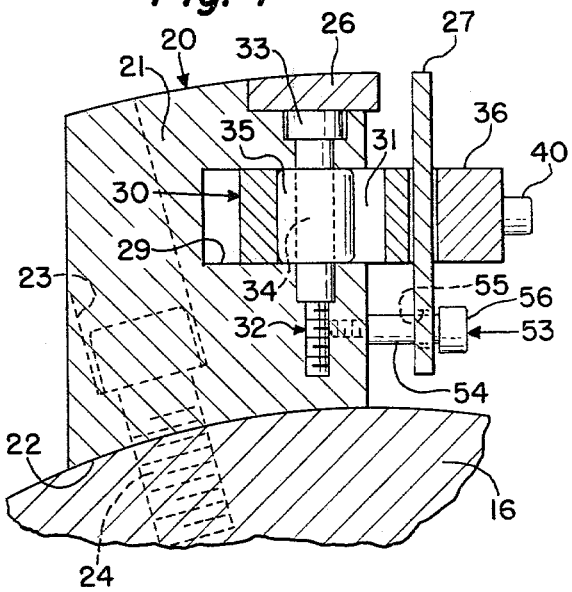
FIG. 4 is a sectional view similar to that shown in FIG. 3, but with the gripping jaws in an open position.
Figure 2:
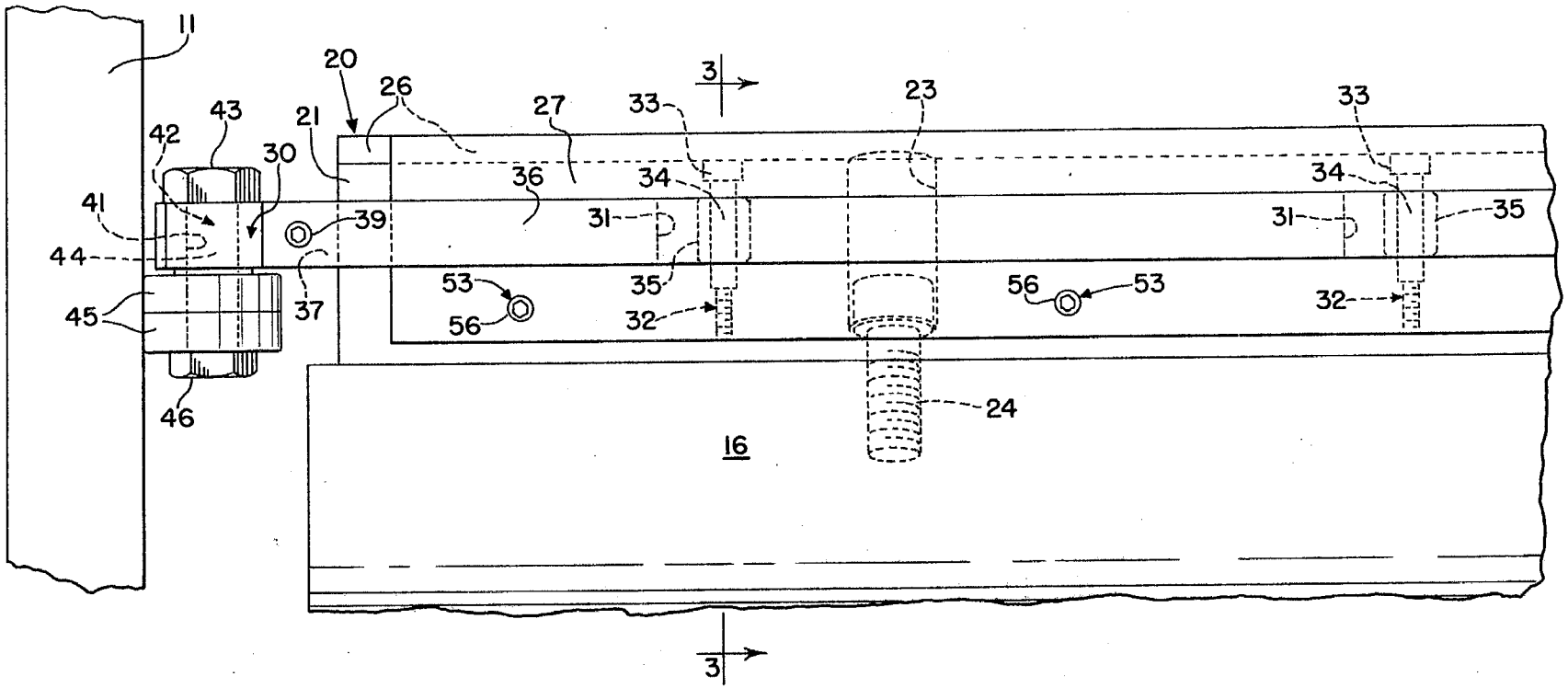
FIG. 2 is an enlarged front elevational view of the working box as shown on the lower of the operational rollers in FIG. 1 and as indicated by the line 2—2 of FIG. 3 and with one end broken away to keep the showing in a large scale.

As best shown in FIG. 1 a printed web 13 is delivered downwardly and laterally in a generally straight line between a pair of cooperative operational rollers which, as defined in our previous patent, carry adjustably positioned working boxes on the cylindrical surfaces thereof. In the present instance a first operational roller 14 is mounted on a shaft 15 which is journally supported 53 are used to hold the plate 27 radially extended and in a position to cooperate with the fixed gripper jaw 26. These confining bolts 53 are shown in FIGS. 2, 3 and 4. Each bolt 53 is provided with a shank 54 which passes loosely through a hole 55 in the jaw plate 27 and then threadedly engages the block 21. A head 56 provided on each bolt 53 acts as an outward limit for the movable gripper jaw 27. The bolts 53 are threadedly set in the block 21 a fixed distance to permit a portion of the shank 54 to be exposed outside the plate 27 when the jaws are closed as in FIG. 3. When the jaws are open as in FIG. 4, the jaw plate 27 has shifted outwardly and now abuts against the bolt head 56 causing the exposed portion of the shank to move to the inner side of the jaw plate 27. The construction of the gripper plate and its assembly provides that it move translationally rather than rockably as in our previous patented embodiments.

OPERATION OF THE DEVICE

Figure 5:
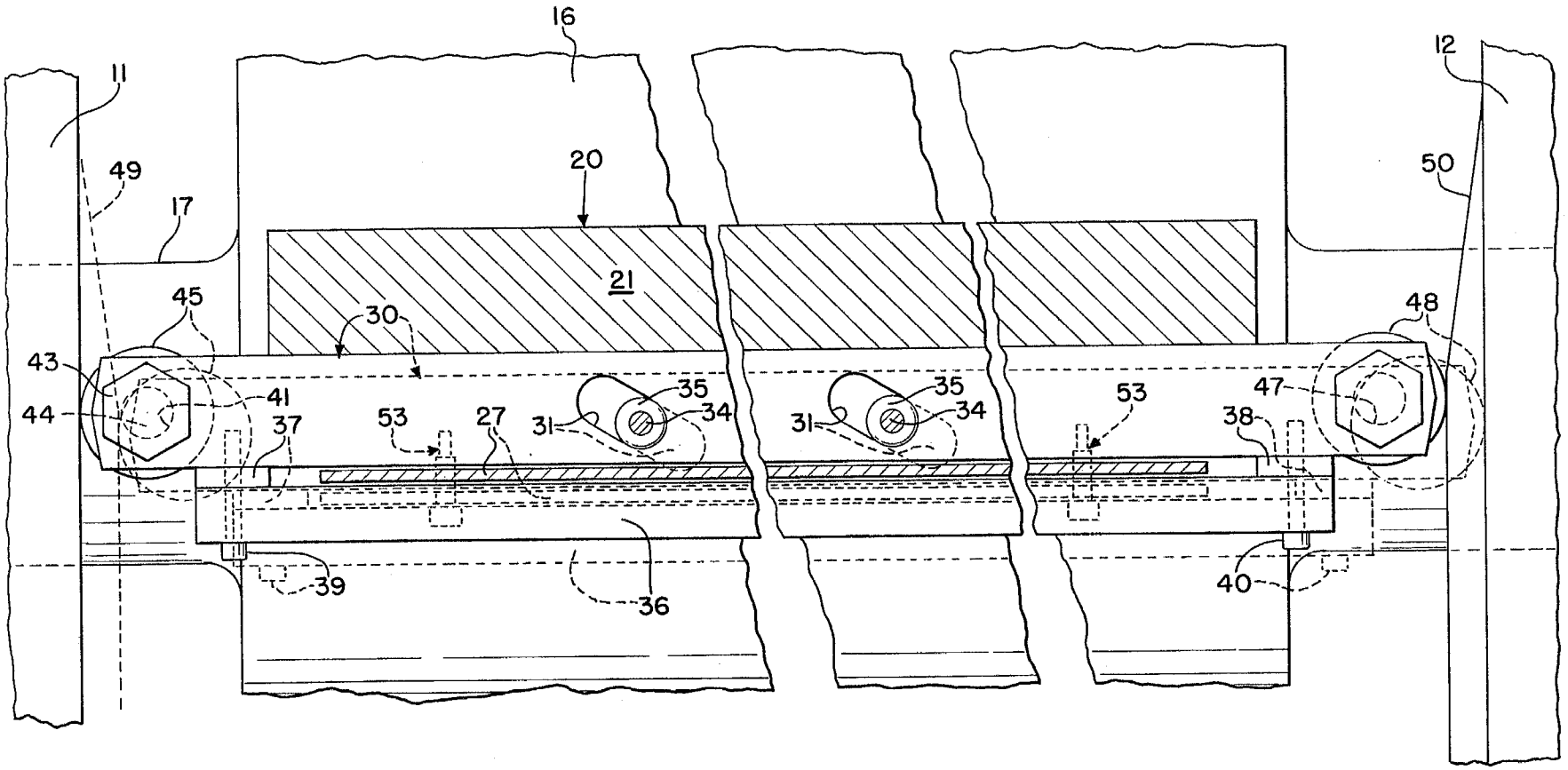
FIG. 5 is a sectional view taken on the line 5—5 of FIG. 3 to disclose the gripping jaws actuator mechanism.

The cooperative operational rollers 14 and 16 are driven in the direction of the arrows 51 and 52 in a manner similar to that shown in our prior U.S. Pat. Nos. 4,073,485 and 4,113,243. A printed web 13 is passed between the rollers 14 and 16 and various working boxes on these rollers are utilized to effect various operations on this printed web. In the present instance the working box 18 has a tucker 19 extending in a generally radial direction from the axis of rotation of the roller 14 and causing a bight 28 of the web 13 to be inserted into the open gripper jaws 26 and 27 of the working box 20 on the cooperative operational roller 16. The jaw 27 is shown in its open position in both of FIGS. 1 and 4. This means that the cam 49 has caused the actuator 30 to be shifted in its endwise direction to the position where the plate jaw 27 is moved translationally outwardly a spaced apart distance from the stationary jaw 26. The full line position of the actuator member 30 in FIG. 5 of the drawings corresponds to the movable jaw 27 being in a closed position relative to the stationary jaw 26. FIG. 3 shows the jaws closed. When the cam 49 takes over and engages the rollers 45 and moves the actuator member in a rightward direction as viewed in the dashed line position of that member in FIG. 5 then the movable jaw 27 is spaced outwardly from the stationary jaw 26 as shown in FIG. 4. When the jaws are open the tucker member 19 is permitted to insert the bight of the printed web 13 into the space between the stationary jaw 26 and the movable jaw 27. Thereafter continued rotation of the operational rollers 14 and 16 in the direction of the arrows 51 and 52 causes a pulling out of the tucker member 19 from the open jaws 26 and 27 and simultaneously a closing of the jaw 27 relative to the jaw 26 causing a gripping of the bight 28 of the printed web remaining between those jaws. The end wall cams 49 and 50 are arranged to open and close the jaws as necessary to effect this gripping of the printed web in a folding operation such as shown in our earlier U.S. Pat. No. 4,073,485.

The present invention is primarily concerned with the cam operated movable gripping jaw. In our previous U.S. Pat. Nos. 4,073,485 and 4,113,243 there was employed an arcuately rockable rod member to effect an opening and a closing of the gripping jaw by a cam operator. The elongated rod member was susceptible to torque and twisting and as a result in order to obtain uniform gripping of the movable jaw with the stationary jaw across the full width of the operational roller the rod had to be quite substantial in size. This type of jaw operator became impractical for use in very wide rollers. The present device overcomes the previous inadequacy of the cam operator by eliminating the use of an arcuately swingable elongated rod. Thus the invention herein relates to the slidable actuator member having a plurality of inclined cam slots along the length of the actuator at suitably spaced apart intervals so that an endwise movement of that actuator member by cams on the spaced apart end walls of the folder permits the movable jaw to be closed with a uniform gripping throughout its length without increasing the size of a member such as a rod actuator member in the prior devices.

Although the actuator member 30 has a combination of endwise movement and fore and aft movement it imparts only a direct fore and aft movement to the plate member gripper jaw 27. The plate 27 thus moves translationally in and out with respect to the fixed jaw 26. There is no rocking of the gripping jaws. This is made possible by the plate confining bolts 53 and the guiding of that plate within the assembly of actuator member 30 and the outer bridge 36.

I am aware that various details of construction may be changed throughout a reasonable range without departing from the principles disclosed herein and I therefore do not propose limiting the patent granted hereon otherwise than as necessitated by the appended claims.

What is claimed is:

1. An actuator for effecting the opening and closing of a movable gripper jaw for paper web folding machines for the printing industry which has a frame support of spaced apart walls, and operational folding roller journally carried for rotation in the spaced apart walls for engaging and folding the paper web, a working box carried transversely on the outer surface of the operational folding roller, the working box havinga stationary jaw on a top side and a cooperating movable gripper jaw on a front side and movable toward and away from the stationary jaw, said actuator comprising said working box having a block with an elongated horizontal groove therein disposed axially of said folding roller and open to the front side adjacent the movable gripper jaw, an elongated actuator member slidable endwise in said groove, said actuator member having a plurality of inclined cam slots at spaced apart intervals therealong, bolt members threadedly affixed in a vertical position from the top side of said block through the horizontal groove and into a lower side of said block and having one each extending through each of said inclined cam slots, roller members journalled on said bolt members at the position of said inclined cam slots, said roller members having a diameter just slightly smaller then the width of the inclined cam slots, said movable gripper jaw abutting the side of said actuator member at the open side of said block groove, a bridge member spaced outwardly of said movable jaw, means spaced from end portions of said movable jaw for joining the bridge member to said actuator member and permitting said movable gripper jaw to have limited separate movement between said actuator member and said bridge member, guide bolts having shank portions slidably passing through openings provided in said movable jaw and having ends threadedly engaging said block, said guide bolts having enlarged heads confining said movable jaw in proximity to said working box and its stationary jaw, cam means on said spaced apart walls for moving said actuator member along said block groove, rollers journally mounted on the ends of said actuator member and adapted to engage the cam means on said spaced apart walls, and said cam means in certain rotated positions of said operational folding roller moving said actuator member to one end of said elongated horizontal groove and causing said movable jaw to abut said stationary jaw, and said cam means in certain other rotated positions of said operational folding roller causing said actuator member to be shifted to the other end of the groove and to cause the roller members to slide to an opposite end of the inclined cam slots and effect an outward shifting of the movable jaw away from the stationary jaw.

2. A device as set forth in claim 1 in which said movable gripper jaw is a generally rectangularly shaped plate, the upper edge of said rectangularly shaped plate extending to the top of said working box and acting to grip a paper web in cooperation with said stationary jaw, and endwise shifting movement of said actuator member causes translational movement of said rectangularly shaped plate of the movable gripper jaw about the confining guide bolts.

3. A web gripper for paper web folding machines for the printing industry, comprising, a frame support including spaced apart walls, an operational folding roller journally carried for rotation in the spaced apart walls for engaging and folding the paper web, a working box carried transversely on the outer surface of the operational folding roller, the working box having a stationary jaw disposed on a top portion of said box and a cooperating movable gripper jaw on a front side of said working box movable toward and away from the stationary jaw, said working box having a block with an elongated horizontal groove therein disposed axially of said folding roller and open to the front side adjacent the movable gripper jaw, an actuator member slidable endwise in said horizontal groove between the spaced apart walls, said actuator member having a plurality of inclined cam slots at spaced apart intervals therealong, bolt members threadedly affixed in a vertical position in said block and having one each extending through each of said inclined cam slots, roller members journalled on said bolt members at the position of said inclined cam slots, said roller members having a diameter just slightly smaller than the width of the inclined cam slots, said movable gripper jaw abutting the side of said actuator member at the open side of said block groove, a bridge member spaced outwardly of said movable jaw, means spaced from end portions of said movable jaw for joining the bridge member to said actuator member and permitting said movable gripper jaw to have limited separate movement between said actuator and said bridge member, guide members having portions slidably passing through openings provided in said movable jaw and having ends engaging said block, cam means on said spaced apart walls, means mounted on end portions of said actuator member and adapted to engage the cam means on said spaced apart walls, and said cam means in certain rotated positions of said operational folding roller moving said actuator member to one end of said elongated horizontal groove and causing said movable jaw to abut said stationary jaw, and said cam means in certain other rotated positions of said operational folding roller causing said actuator member to be shifted to the other end of thegroove and to cause the roller members to slide to an opposite end of the inclined cam slots and effect an outward shifting of the movable jaw away from the stationary jaw.

4. A web gripper for use in a web folder comprising a frame structure, a folding roller journaled for rotation in said frame structure for engaging and folding a paper web, a working box carried transversely on the outer surface of said roller, the working box having a stationary jaw and an elongated endwise movable actuator axiallyslidable on said folding roller, cam means on said frame structure for effecting the sliding of said actuator, a movable jaw supported for movement on said endwise moving actuator, means guiding said moving jaw relative to said stationary jaw for movement towards and away from said stationary jaw, said means including a plurality of inclined cam slots within said endwise movable actuator at spaced apart intervals therealong, rollers affixed to the working box and disposed in each of the inclined cam slots to effect a positive movement of said moving jaw toward and away from said stationary jaw upon endwise movement of said actuator.

* * * * *